US006709719B2

(12) United States Patent
Kanematsu et al.

(10) Patent No.: US 6,709,719 B2
(45) Date of Patent: Mar. 23, 2004

(54) METHOD FOR PRODUCING A TIN-ZINC ALLOY FILM

(75) Inventors: Hideyuki Kanematsu, Suzuka (JP); Yoshihiko Masuo, Anjyo (JP); Takeo Oki, Tsushima (JP); Hirohiko Ohmura, Nagoya (JP)

(73) Assignee: Susuka National College of Technology, Suzuka (JP)

( * ) Notice: Subject to any disclaimer, the term of this patent is extended or adjusted under 35 U.S.C. 154(b) by 0 days.

(21) Appl. No.: 10/145,902

(22) Filed: May 16, 2002

(65) Prior Publication Data

US 2003/0026913 A1 Feb. 6, 2003

(30) Foreign Application Priority Data

Jun. 14, 2001 (JP) ..... 2001-180387

(51) Int. Cl.[7] ..... B05D 3/06; B05D 1/36

(52) U.S. Cl. ..... 427/554; 427/404; 427/405; 427/406; 205/170; 205/228; 205/300; 205/305

(58) Field of Search ..... 427/554, 404, 427/405, 406; 205/170, 228, 300, 305

(56) References Cited

U.S. PATENT DOCUMENTS

| | | | | | |
|---|---|---|---|---|---|
| 3,633,059 | A | * | 1/1972 | Nishizawa et al. | 313/499 |
| 4,495,255 | A | * | 1/1985 | Draper et al. | 428/669 |
| 4,999,258 | A | * | 3/1991 | Wake et al. | 428/632 |
| 6,183,886 | B1 | * | 2/2001 | Chen et al. | 428/647 |
| 2002/0192390 | A1 | * | 12/2002 | Hartig et al. | 427/455 |

FOREIGN PATENT DOCUMENTS

JP A 2001-165791 6/2001

* cited by examiner

*Primary Examiner*—Michael Barr
(74) *Attorney, Agent, or Firm*—Oliff & Berridge, PLC

(57) ABSTRACT

A tin layer and a zinc layer are stacked sequentially on a given substrate to form a multilayered film composed of the tin layer and the zinc layer. Then, a laser beam is irradiated onto the multilayered film to produce a tin-zinc alloy film through the inter-diffusion between the tin elements of the tin layer and the zinc elements of the zinc layer.

6 Claims, 2 Drawing Sheets

METHOD FOR PRODUCING A TIN-ZINC ALLOY FILM

BACKGROUND OF THE INVENTION

1. Field of the Invention

This invention relates to a method for producing a tin-zinc alloy film, particularly a method for producing a tin-zinc alloy film for corrosion-resistant purposes.

2. Description of the Prior Art

Recently, an attention has been paid to a tin-zinc alloy film to replace for a corrosion-resistant cadmium plating film. Such a cadmium plating film itself has excellent corrosion-resistance and thus, is employed as a material for an aircraft at present. However, the cadmium plating film is strictly restricted in use because it has harmful element, Cd for environment. In this point of view, the use of the cadmium plating film would be more severely restricted in future. Therefore, the tin-zinc alloy film would play very important roles in future instead of the cadmium plating film.

In the past, the tin-zinc film would be produced from a given water solution by means of alloy-electroplating, and thus, two different metals, tin and zinc, must be electroplated at the same voltage. Therefore, all kinds of things to perform the electroplating at the same voltage have been carried out. Moreover, chemical species to be used have been restricted, and anti-environmental additives have been used.

Furthermore, the above electroplated tin-zinc film from the water solution always has a thermally non-equilibrium phase which is not recognized in its equilibrium diagram. The non-equilibrium phase often shifts to another stable phase due to the wear or the heating in the use of the tin-zinc alloy film, and thus, the properties of the tin-zinc alloy film often change. Therefore, the functions imparted to the tin-zinc alloy film for predetermined purposes may change during the use of the film, so that it may be that the tin-zinc alloy film can not exhibit the predetermined functions in use.

Such a technique is described in Japanese Patent Application Laid-open No. 01-165791 as plating a zinc film and a tin film in their respective predetermined thickness on a given steel plate and then, melting the tin film and diffusing the tin elements into the zinc film through a given thermal treatment, to produce a tin-zinc alloy film. With such a technique, however, the tin elements and the zinc elements are inclined in the tin-zinc alloy film in concentration, so that the tin elements and the zinc elements can not be alloyed perfectly.

SUMMERY OF THE INVENTION

It is an object of the present invention to provide a method for producing a stable tin-zinc alloy where the tin elements and the zinc elements are perfectly alloyed and the predetermined functions such as corrosion-resistance can be exhibited sufficiently.

For achieving the above object, this invention relates to a method for producing a tin-zinc alloy film comprising the steps of:

depositing a tin layer and a zinc layer on a given substrate sequentially, thereby to form a multilayered film composed of the tin layer and the zinc layer, and irradiating a laser beam onto the multilayered film to produce a tin-zinc alloy film.

The inventors had intensely studied to alloy tin elements and zinc elements perfectly, to obtain a uniform and stable tin-zinc alloy film. As a result, they found out that a tin layer and a zinc layer which includes the tin elements and the zinc elements are stack, and then, a given laser beam is irradiated onto the thus obtained multilayered film, to alloy the tin elements and the zinc elements perfectly through the inter-diffusion and produce a tin-zinc alloy film desired which can exhibit excellent corrosion-resistance in use for a long time.

According to the present invention, the tin-zinc alloy film, where the tin elements and the zinc elements are perfectly and uniformly alloyed, can be is produced through the inter-diffusion between the tin elements and the zinc elements in a short time without the creation of a non-equilibrium phase. Therefore, various functions such as corrosion-resistance imparted to the tin-zinc alloy film in advance can be maintained for a long time, and thus, the running cost for the tin-zinc alloy film can be reduced because the producing period of time for the alloy film can be shortened.

BRIEF DESCRIPTION OF THE DRAWINGS

For better understanding of the present invention, reference is made to the attached drawings, wherein FIGS. 1(*a*)–(*c*) are X-ray diffraction profiles of tin-zinc alloy films obtained by the producing method of the present invention, respectively and FIGS. 2(*a*)–(*c*) are also X-ray diffraction profiles of tin-zinc alloy films obtained by the producing method of the present invention, respectively.

DESCRIPTION OF THE PREFERRED EMBODIMENTS

Figure 1A:
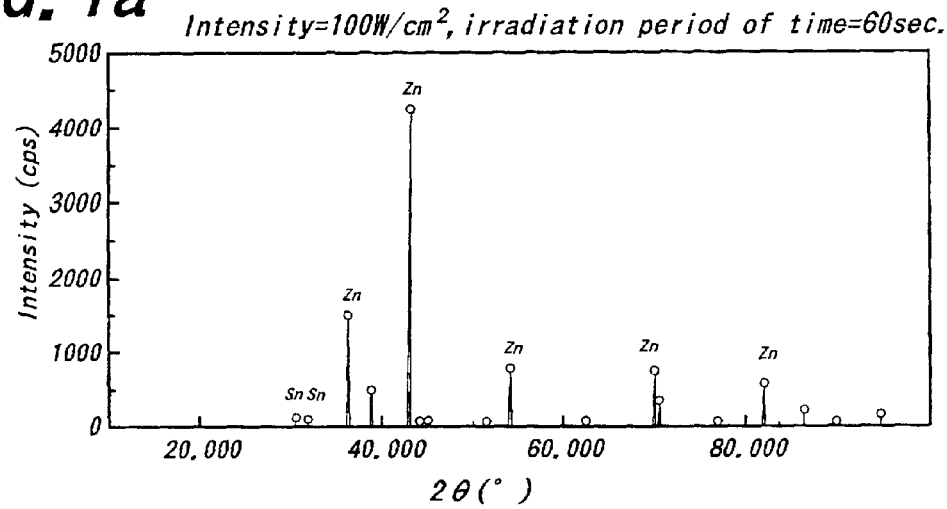

This invention will be described in detail by way of examples with reference to the accompanying drawings.

In the present invention, it is required that after a multilayered film is made of a tin layer and a zinc layer, a laser beam is irradiated to the multilayered film. The intensity of the laser beam is preferably set within 50 W/cm$^2$ to 500 W/cm$^2$, particularly within 150 W/cm$^2$ to 250 W/cm$^2$. In this case, the tin elements and the zinc elements can be inter-diffused in good condition.

If the intensity of the laser beam is beyond the above intensity range, some of the tin elements may be evaporated and the diffusion of the tin elements and the zinc elements may be carried out at once. As a result, it may be that the diffusion condition can not be controlled precisely, not to be able to produce a tin-zinc alloy film desired. Moreover, if the intensity of the laser beam is less than the above intensity range, it takes long time in the diffusion of the tin elements and the zinc elements.

The irradiation period of time of the laser beam depends on the laser beam intensity, the thickness of the tin layer and the zinc layer, and the alloy degree of the tin-zinc alloy film to be produced. However, it is desired that the irradiation period of time is set within 5–60 seconds, particularly within 20–60 seconds.

In this case, the diffusion of the tin elements and the zinc elements can be controlled precisely, irrespective of the thickness of the tin layer and the zinc layer and so on, and thus, the desired tin-zinc alloy film can be produced efficiently. It is surprising that the desired tin-zinc alloy film can be produced in such a short irradiation period.

When a laser beam having an intensity of the above intensity range is irradiated onto the multilayered film made of the tin layer and the zinc layer, the multilayered film is easily heated to a temperature within a range of the melting point, 232° C. of tin through the boiling point, 2632° C. of tin in the above short irradiation period. In this case, the tin layer is melted to be its liquid phase. Then, the tin liquid diffuses into the boundaries between the zinc particles of the zinc layer, and then, the tin-zinc alloy film which has a large alloy degree can be obtained in a relatively short period of time.

A gas laser such as a He—Ne laser, a $CO_2$ laser, an Excimer laser and a solid-state laser such as a Nd:YAG laser may be exemplified as a laser source to output the above laser beam.

Moreover, the stacking order of the tin layer and the zinc layer in the multilayered film is not particularly restricted, but it is desired to stack the tin layer on the zinc layer.

In the case of forming the zinc layer on the tin layer to form the multi-layered film, first of all, the tin layer is electroplated on a given substrate, and thereafter, the zinc layer is formed from a strong acidic bath such as a zinc sulfate bath. Therefore, the tin layer is immersed into the strong acidic bath for a long time during the formation of the zinc layer. As a result, the tin layer is partially melted and reduced in its thickness.

Therefore, if a tin-zinc alloy film is made of such a multilayered film including the tin layer reduced in thickness, the tin content of the alloy film is decreased and the sort of stable phase is restricted. Therefore, for setting the tin content of the tin-zinc alloy film to a predetermined amount, it is required that the tin layer is formed thicker so as to compensate the thickness of the tin layer to be reduced.

On the other hand, if the zinc layer and the tin layer are stacked in turn, the tin layer is not immersed into the strong acidic bath and thus, not reduced in its thickness. As a result, the tin-zinc alloy film having a desired tin content can be easily formed.

Moreover, it is preferable that the thickness of the tin layer is 10–50 $\mu$m, and the thickness of the zinc layer is 10–50 $\mu$m. In this case, the tin-zinc alloy film can be obtained through the subsequent laser beam irradiation process so as to be able to have various stable phases. Moreover, if the tin layer and the zinc layer have the above thickness, the fluctuation margin in the electroplating condition for forming the above tin layer and zinc layer is allowable to some degree. That is, even though the electroplating condition for forming the tin layer and the zinc layer is fluctuated slightly, the tin layer and the zinc layer can have thickness within the above thickness range, respectively.

Although the tin layer and the zinc layer are deposited on a given substrate, the depositing means is not particularly restricted. However, the tin layer and the zinc layer are preferably electroplated on the given substrate because the electroplating can form the layers thicker in a relatively short time and the electroplating has its easy operationality.

In forming the tin layer by the electroplating method, an electroplating bath such as an acidic bath or an alkaline bath may be used. A sulfuric acid bath, a methanosulfonic acid bath or a tetrafluoroboric acid bath may be exemplified as the acidic bath. In forming the zinc layer by the electroplating method, an electroplating bath mainly including zinc sulfate and/or zinc chloride may be employed.

Through the above process according to the present invention, the tinzinc alloy film, which does not include a non-equilibrium phase and in which the tin elements and the zinc elements are perfectly alloyed, can be obtained. Then, the alloy film has preferably at least one of solid solution and eutectic alloy of tin and zinc. In this case, the properties of the alloy film, that is, the functions imparted to the alloy film can be maintained for a long time.

EXAMPLES

This invention is concretely described on the following examples, but is not restricted to the examples.

Example 1

A pure iron plate having a thickness of 2 mm was employed as a substrate, and then, immersed into a fluoroboric acid bath having a total amount of 300 ml which included 18 ml of 42%-boric hydrofluoric acid, 2 ml of 44.6%-fluoroboric tin and 15 mg of polyethylene glycol (molecular weight=2000). Then, the fluoroboric acidic bath was electrolyzed by flowing a current at a current density of 1 A/dm$^2$ for five minutes to form a tin layer in a thickness of 30 $\mu$m on the iron plate.

Then, the iron plate having the tin layer thereon was immersed into a zinc plating bath having a total amount of 300 ml which included 137 g of zinc chloride, 10 g of boric acid, 5 g of natrium chloride and 10 g of aluminum sulfate and which was heated to 40° C. Then, the zinc plating bath was electrolyzed by flowing a current at a current density of 20 A/dm$^2$ for five minutes to form a zinc layer in a thickness of 50 $\mu$m on the tin layer, to fabricate a multilayered film composed of the tin layer and the zinc layer. During the formation of the zinc layer, it was recognized that the thickness of the tin layer was reduced up to several $\mu$m.

Then, a laser beam from a $CO_2$ laser was uniformed by a Kaleidoscope, and was irradiated onto the multilayered film for 20–60 seconds at an irradiation intensity of 100–300 W/cm$^2$, to produce a tin-zinc alloy film.

Figure 1B:
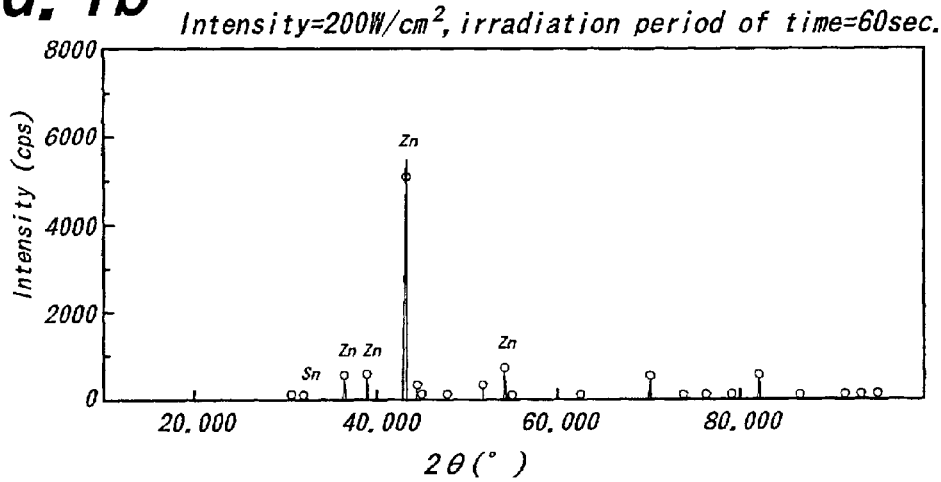
Figure 1C:
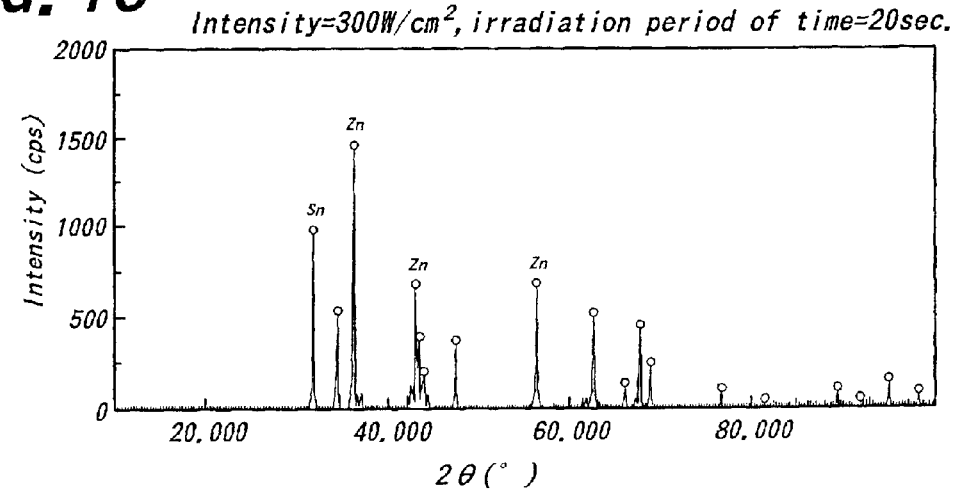

FIGS. 1(*a*)–(*c*) are X-ray diffraction profiles of the thus obtained tinzinc alloy films, respectively. FIG. 1(*a*) shows the X-ray diffraction profile of the tin-zinc alloy film produced by the laser irradiation of an intensity of 100 W/cm$^2$ and an irradiation period of 60 seconds. FIG. 1(*b*) shows the X-ray diffraction profile of the tin-zinc alloy film produced by the laser irradiation of an intensity of 200 W/cm$^2$ and an irradiation period of 60 seconds. FIG. 1(*c*) shows the X-ray diffraction profile of the tin-zinc alloy film produced by the laser irradiation of an intensity of 300 W/cm$^2$ and an irradiation period of 20 seconds.

As is apparent from FIGS. 1(*a*)–(*c*), since only the diffraction peaks relating to tin and zinc are observed and no diffraction peaks relating to tin-zinc alloy is observed, it is turned out that a mixed crystal of solid solution and eutectic alloy made of tin and zinc is created in the tin-zinc alloy films, respectively.

According to this Example, therefore, the tin-zinc alloy film, which does not include a thermally non-equilibrium phase and in which the tin elements and the zinc elements are perfectly and uniformly alloyed, can be obtained. The state of the tin-zinc alloy film of the mixed crystal being created therein was also confirmed by means of electron beam microanalyzer built in a scanning microscope.

Example 2

A pure iron plate having a thickness of 2 mm was used as a substrate, and then, was immersed into a zinc plating bath having a total amount of 300 ml which included 137 g of zinc chloride, 10 g of boric acid, 5 g of natrium chloride and 10 g of aluminum sulfate. Then, the zinc plating bath was electrolyzed by flowing a current at a current density of 20 A/dm$^2$ for five minutes to form a zinc layer in a thickness of 50 $\mu$m on the iron plate.

Then, the iron plate having the zinc layer thereon was immersed into a fluoroboric acid bath having a total amount of 300 ml which included 18 ml of 42%-boric hydrofluoric acid, 2 ml of 44.6%-fluoroboric tin and 15 mg of polyethylene glycol (molecular weight=2000). Then, the fluoroboric acidic bath was electrolyzed by flowing a current at a current density of 1 A/dm$^2$ for five minutes to form a tin layer in a thickness of 30 $\mu$m on the zinc layer, to fabricate a multilayered film composed of the zinc layer and the tin layer. Then, a laser beam was irradiated from a $CO_2$ laser onto the multilayered film for 20–60 seconds at an irradiation intensity of 100–300 W/cm$^2$, to produce a tin-zinc alloy film.

Figure 2A:
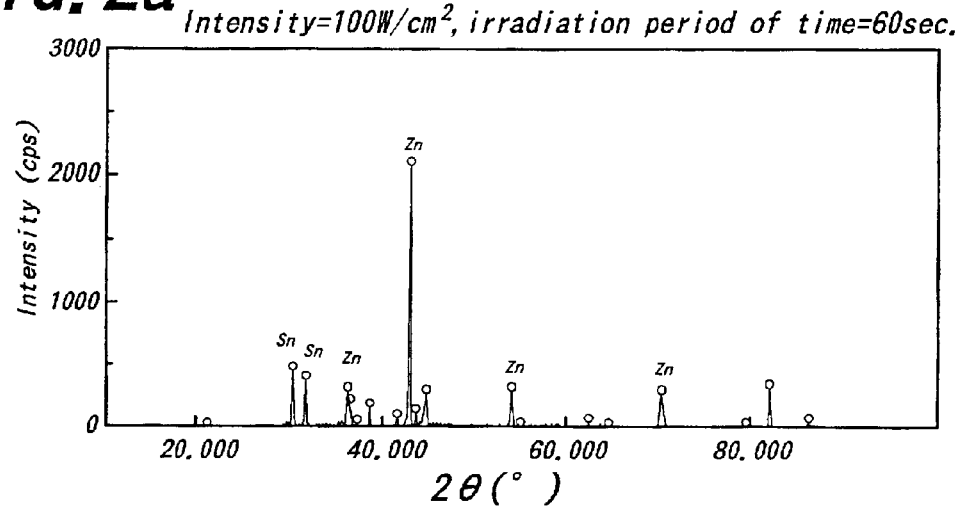
Figure 2B:
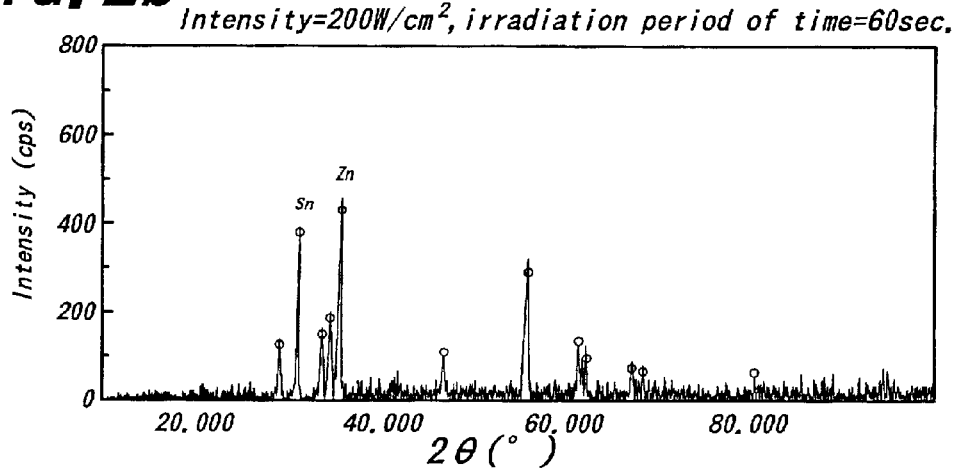
Figure 2C:
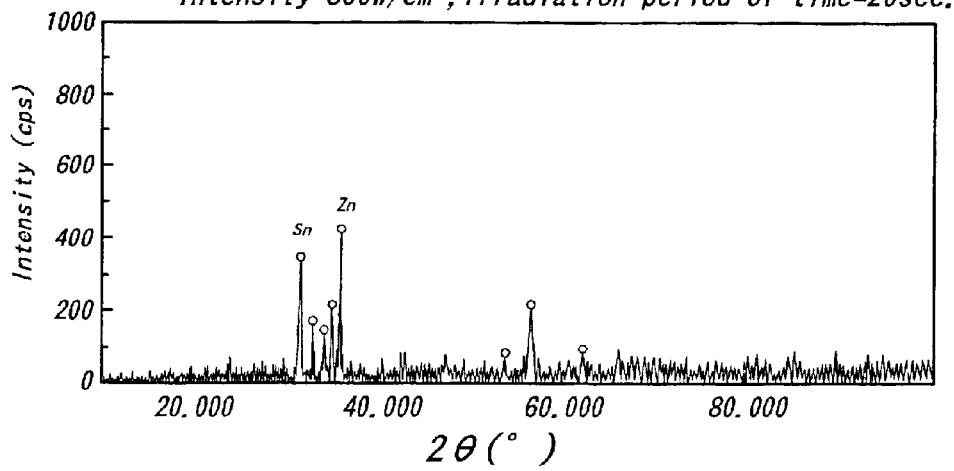

FIGS. 2(*a*)–(*c*) are X-ray diffraction profiles of the thus obtained tinzinc alloy films, respectively. FIG. 2(*a*) shows the X-ray diffraction profile of the tin-zinc alloy film produced by the laser irradiation of an intensity of 100 W/cm$^2$ and an irradiation period of 60 seconds. FIG. 2(*b*) shows the X-ray diffraction profile of the tin-zinc alloy film produced by the laser irradiation of an intensity of 200 W/cm$^2$ and an irradiation period of 60 seconds. FIG. 2(*c*) shows the X-ray diffraction profile of the tin-zinc alloy film produced by the laser irradiation of an intensity of 300 W/cm$^2$ and an irradiation period of 20 seconds.

As is apparent from FIGS. 2(*a*)–(*c*), since only the diffraction peaks relating to tin and zinc are observed and no diffraction peaks relating to tin-zinc alloy is observed, it is turned out that a mixed crystal of solid solution and eutectic alloy made of tin and zinc is created in the tin-zinc alloy films, respectively.

According to this Example, therefore, the tin-zinc alloy film, which does not include a thermally non-equilibrium phase and in which the tin elements and the zinc elements are perfectly and uniformly alloyed, can be obtained. The state of the tin-zinc alloy film of the mixed crystal being created therein was also confirmed by means of electron beam microanalyzer built in a scanning microscope.

Although the present invention was described in detail with reference to the above examples, this invention is not limited to the above disclosure and every kind of variation and modification may be made without departing from the scope of the present invention.

As is explained above, according to the present invention, a tin-zinc alloy film, which does not include unstable phase and in which the tin elements and the zinc elements are perfectly alloyed, can be provided. Therefore, the change in property of the alloy film can be repressed regardless of the wear and the heating in use. As a result, the functions imparted to the alloy film in advance can be maintained for a long time.

What is claimed is:

1. A method for producing a tin-zinc alloy film comprising the steps of:

depositing a tin layer and a zinc layer on a substrate sequentially to form a multilayered film composed of said tin layer and said zinc layer, and irradiating said multilayered film with a laser beam at an intensity and for a period of time sufficient to produce a tin-zinc alloy film.

wherein said tin-zinc alloy film is a substantially solid solution and a substantially eutectic crystal of tin and zinc.

2. The method of claim 1, wherein the intensity of said laser beam is set within 50 W/cm$^2$–500 W/cm$^2$.

3. The method of claim 1, wherein the irradiation period of said laser beam is set within 5–60 seconds.

4. The method of claim 1, wherein in said multilayered film, said tin layer is stacked on said zinc layer.

5. The method of claim 1, wherein the thickness of said tin layer is set within 10–50 $\mu$m, and the thickness of said zinc layer is set within 10–50 $\mu$m.

6. The method of claim 1, wherein said tin layer and said zinc layer are deposited by an electroplating method.

* * * * *

UNITED STATES PATENT AND TRADEMARK OFFICE

CERTIFICATE OF CORRECTION

PATENT NO. : 6,709,719 B2
DATED : March 23, 2004
INVENTOR(S) : Hideyuki Kanematsu et al.

It is certified that error appears in the above-identified patent and that said Letters Patent is hereby corrected as shown below:

Title page,
Item [73], Assignee, "Susuka National College of Technology", should read
-- Suzuka National College of Technology --

Signed and Sealed this

Second Day of November, 2004

JON W. DUDAS
*Director of the United States Patent and Trademark Office*